US009552939B2

(12) United States Patent
Hwa

(10) Patent No.: US 9,552,939 B2
(45) Date of Patent: Jan. 24, 2017

(54) KEYBOARD EQUIPPED WITH MULTIPOINT PRESS POSITIONS

(71) Applicant: ZIPPY TECHNOLOGY CORP., New Taipei (TW)

(72) Inventor: Chin-Hsiu Hwa, New Taipei (TW)

(73) Assignee: ZIPPY TECHNOLOGY CORP., New Taipei (TW)

( * ) Notice: Subject to any disclaimer, the term of this patent is extended or adjusted under 35 U.S.C. 154(b) by 30 days.

(21) Appl. No.: 14/486,199

(22) Filed: Sep. 15, 2014

(65) Prior Publication Data

US 2016/0079012 A1 Mar. 17, 2016

(51) Int. Cl.
*H01H 13/78* (2006.01)
*H01H 13/64* (2006.01)

(52) U.S. Cl.
CPC ..... *H01H 13/78* (2013.01); *H01H 13/64* (2013.01); *H01H 2203/036* (2013.01); *H01H 2217/004* (2013.01); *H01H 2221/044* (2013.01); *H01H 2221/064* (2013.01); *H01H 2225/01* (2013.01); *H01H 2227/028* (2013.01); *H01H 2227/034* (2013.01); *H01H 2233/002* (2013.01)

(58) Field of Classification Search
CPC ..... H01H 3/12; H01H 3/122; H01H 13/78; H01H 13/64; H01H 2217/004; H01H 2221/044; H01H 2225/01; H01H 2227/028; H01H 2233/002
USPC ..... 200/6 A, 5 R, 18, 341, 344
See application file for complete search history.

(56) References Cited

U.S. PATENT DOCUMENTS 4,256,931 A * 3/1981 Palisek ..... H01H 25/041 200/5 A
6,525,279 B2 * 2/2003 Sato ..... H01H 25/041 200/18
7,094,979 B2 * 8/2006 Kurokawa ..... H01H 25/041 200/5 R
7,872,202 B2 * 1/2011 Na ..... G06F 3/0338 200/5 R (Continued)

FOREIGN PATENT DOCUMENTS

TW I346965 8/2011
TW I396218 5/2013

*Primary Examiner* — Felix O Figueroa
(74) *Attorney, Agent, or Firm* — Muncy, Geissler, Olds & Lowe, P.C.

(57) ABSTRACT

A keyboard equipped with multipoint press positions comprises at least a baseboard, a keycap assembly and a command trigger assembly. The keycap assembly includes a support frame to hold a plurality of keycaps. The command trigger assembly includes a command circuit board and a plurality of elastic switches. The command circuit board includes a plurality of trigger portions corresponding to the keycaps and triggered by the keycaps, and at least one primary command circuit electrically connected to each trigger portion. The elastic switches are corresponding to and depressible by the keycaps to trigger the trigger portions. Each elastic switch includes a base and a primary movement portion, a first secondary movement portion and a second secondary movement portion that are respectively corresponding to a primary trigger switch and at least two secondary trigger switches of the trigger portions. The keyboard thus formed can provide higher press sensitivity.

7 Claims, 7 Drawing Sheets

(56) References Cited

U.S. PATENT DOCUMENTS

| | | | | |
|---|---|---|---|---|
| 8,476,542 | B2 * | 7/2013 | Hagiwara | H01H 25/041 200/5 R |
| 2014/0166459 | A1 * | 6/2014 | Armendariz | H01H 13/64 200/5 A |

* cited by examiner

KEYBOARD EQUIPPED WITH MULTIPOINT PRESS POSITIONS

FIELD OF THE INVENTION

The present invention relates to a keyboard and particularly to a thin and light keyboard equipped with multipoint press positions to provide multiple points contact.

BACKGROUND OF THE INVENTION

With rapid growth of information technology electronic equipments also become very popular. Take the commonly used computers as example, they can be grouped to desktop computers, notebook computers and tablet computers. To increase computer document processing speed most computers are incorporated with a keyboard to facilitate data entry operation of users. The keyboard generally has keycaps and a baseboard. Each keycap and the baseboard are bridged by a key strut. When the keycap is stricken by a user the key strut supports the keycap to form vertical movement against the baseboard. Thus, when the keycap is pressed a switch on the baseboard can be triggered to transmit a reference signal to the processor to output a desired output signal. In addition, to avoid the keycap from being stricken by the user at two sides rather than in the center and result in tilting and unstable, or unable to trigger the switch, a high sensitive keyboard has been developed in the industry to enable the user to strike the key even on corners and still can trigger the switch.

For instance, Taiwan patent No. 1346965 discloses a high sensitive key structure. It mainly provides a plurality of protruding units on outer sides of a keycap and a plurality of suspending arm units on a baseboard. When a user presses the edges of the keycap the protruding units touch the suspending arm units to make the free end of suspending arm units to set on a circuit switch via the lever principle. Hence even if the key is being pressed unevenly the circuit switch still can be activated, thus can achieve high sensitivity.

In addition, Taiwan patent No. 1396218 also proposes a keyboard which mainly has a plurality of trigger portions on a keycap and a plurality of switches on a thin film circuit board corresponding to the trigger portions. A user can press merely any corner of the keycap to touch and set on a switch to output a signal, therefore can improve the sensitivity of the keycap.

The aforesaid keyboards use an elastic support rack to support the keycap, then through a press point protruding sideward from the elastic support rack to touch a switch on a circuit board that is located on a corresponding press point. Furthermore, all the aforesaid keyboards include an elastic support rack. The press point of the keycap generates a relative swing about the elastic support rack as a fulcrum. However, the elastic support rack makes shrinking the size of the keyboard difficult. Moreover, user has to forcefully press the keycap to deform the elastic support rack to make the press point to touch the switch. If the user lightly touches the corners of the keycap set-on connection could fail. All this shows that to design a high sensitivity multipoint contact keyboard that also is thin and light still is an issue pending to be resolved.

SUMMARY OF THE INVENTION

The primary object of the present invention is to solve the problems of the conventional keyboards of bulky in size and inferior in contact sensitivity.

To achieve the foregoing object the invention provides a keyboard equipped with multipoint press positions. It comprises at least a baseboard, a keycap assembly and a command trigger assembly triggered by the keycap assembly to output keyboard commands. The keycap assembly includes a support frame to hold a plurality of keycaps. The command trigger assembly includes a command circuit board and a plurality of elastic switches. The command circuit board includes a plurality of trigger portions corresponding to the keycap press positions and triggered by the keycaps to output the keyboard commands, and at least one primary command circuit electrically connected to each trigger portion. Each trigger portion includes at least one primary trigger switch located corresponding to a central position of each keycap and at least two secondary trigger switches spaced from the primary trigger switch at a preset distance. Each secondary trigger switch has a first auxiliary trigger switch and a second auxiliary trigger switch opposing each other relative to the primary trigger switch. The primary trigger switch and the secondary trigger switches are interposed by at least one secondary command circuit to form electrical connection thereof. The elastic switches are located corresponding to the keycap press positions and depressible by the keycaps to trigger the trigger portions to output the keyboard commands. Each elastic switch includes a base, a primary movement portion located on the base and corresponding to the primary trigger switch, a secondary movement portion located on the base and corresponding to the first auxiliary trigger switch, and a second secondary movement portion located on the base and corresponding to the secondary auxiliary trigger switch.

In one embodiment of the invention each keycap has four sides and four corners formed respectively by joining any two of the four sides. The first auxiliary trigger switch is corresponding to any two opposing sides and located between one of the two opposing sides and the primary trigger switch. The second auxiliary trigger switch correspond the two opposing sides and being located between another one of the two sides and the primary trigger switch.

In another embodiment of the invention each keycap has four sides and four corners formed respectively by joining any two of the four sides. The first auxiliary trigger switch is corresponding to any two opposing corners and located between one of the two opposing corners and the primary trigger switch. The second auxiliary trigger switch correspond the two opposing corners and being located between another one of the two corners and the primary trigger switch.

In yet another embodiment of the invention the primary movement portion includes a primary movement strut depressible by the keycap to move toward the command circuit board to trigger the primary trigger switch and a primary deformation section connected to the primary movement strut to provide a return action force to the primary movement strut. The first secondary movement portion includes a first secondary movement strut depressible by the keycap to move toward the command circuit board to trigger the first auxiliary trigger switch and a first secondary deformation section connected to the first secondary movement strut to provide a return action force to the first secondary movement strut. The second secondary movement portion includes a second secondary movement strut depressible by the keycap to move toward the command circuit board to trigger the second auxiliary trigger switch and a second secondary deformation section connected to the second secondary movement strut to provide a return action force to the second secondary movement strut.

In yet another embodiment of the invention the primary movement portion is formed at a length greater than that of the first and second secondary movement sections.

In yet another embodiment of the invention the first secondary movement strut includes a first press plane facing the keycap and a first press sloped surface connected to the first press plane and located at one side thereof remote from the primary movement strut. The second secondary movement strut includes a second press plane facing the keycap and a second press sloped surface connected to the second press plane and located at one side thereof remote from the primary movement strut.

In yet another embodiment of the invention the command circuit board includes a lower circuit board and an upper circuit board that hold respectively the primary trigger switch and the secondary trigger switches, and a spacer located between the lower circuit board and the upper circuit board and included a plurality of openings corresponding to the primary trigger switch and the secondary trigger switches.

In yet another embodiment of the invention the support frame includes a plurality of installation apertures defined by a plurality of bracing stems which are formed in a staggered manner to hold the keycaps. Each keycap has four sides and four corners formed respectively by joining any two of the four sides. The bracing stems include a plurality of wall surfaces facing the four sides. The four sides and the wall surfaces are bridged by four movable racks respectively. The four movable racks and the keycaps and the bracing stems are integrally formed by injection. Each movable rack has a first stem connecting section connected to any one of the corners and a bracing arm section connected to the first stem connecting section and connected to the any one of the corners via a first bend spot towards another corner to connect to another bracing stem.

In yet another embodiment of the invention the support frame includes a plurality of installation apertures defined by a plurality of bracing stems which are formed in a staggered manner to hold the keycaps. Each keycap has four sides and four corners formed respectively by joining any two of the four sides. The bracing stems include a plurality of wall surfaces facing the sides. The four sides and the wall surfaces are bridged by four movable racks respectively. The four movable racks and the keycaps and the bracing stems are integrally formed by injection. Each movable rack has a first stem connecting section, a second stem connecting section and a bracing arm section to bridge the first stem connecting section and the second stem connecting section. The first stem connecting section is connected to any one of the corners. The bracing arm section is connected to the first stem connecting section via a first bend spot and extending between the side and the bracing stem toward another corner to form the second stem connecting section by extending from the another corner via a second bend spot to connect to the bracing stem.

The keyboard equipped with multipoint press positions of the invention thus formed, compared with the conventional keyboards, provides features as follows:

1. Through the keycaps and the elastic switches total size of the keyboard can be shrunk as desired, therefore the keyboard can be made thinner and lighter in weight.

2. With the elastic switches and the trigger switches included in the keyboard, any spot of the keycaps can be pressed to trigger the elastic switches and set on the trigger switches, therefore achieve higher press sensitivity.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
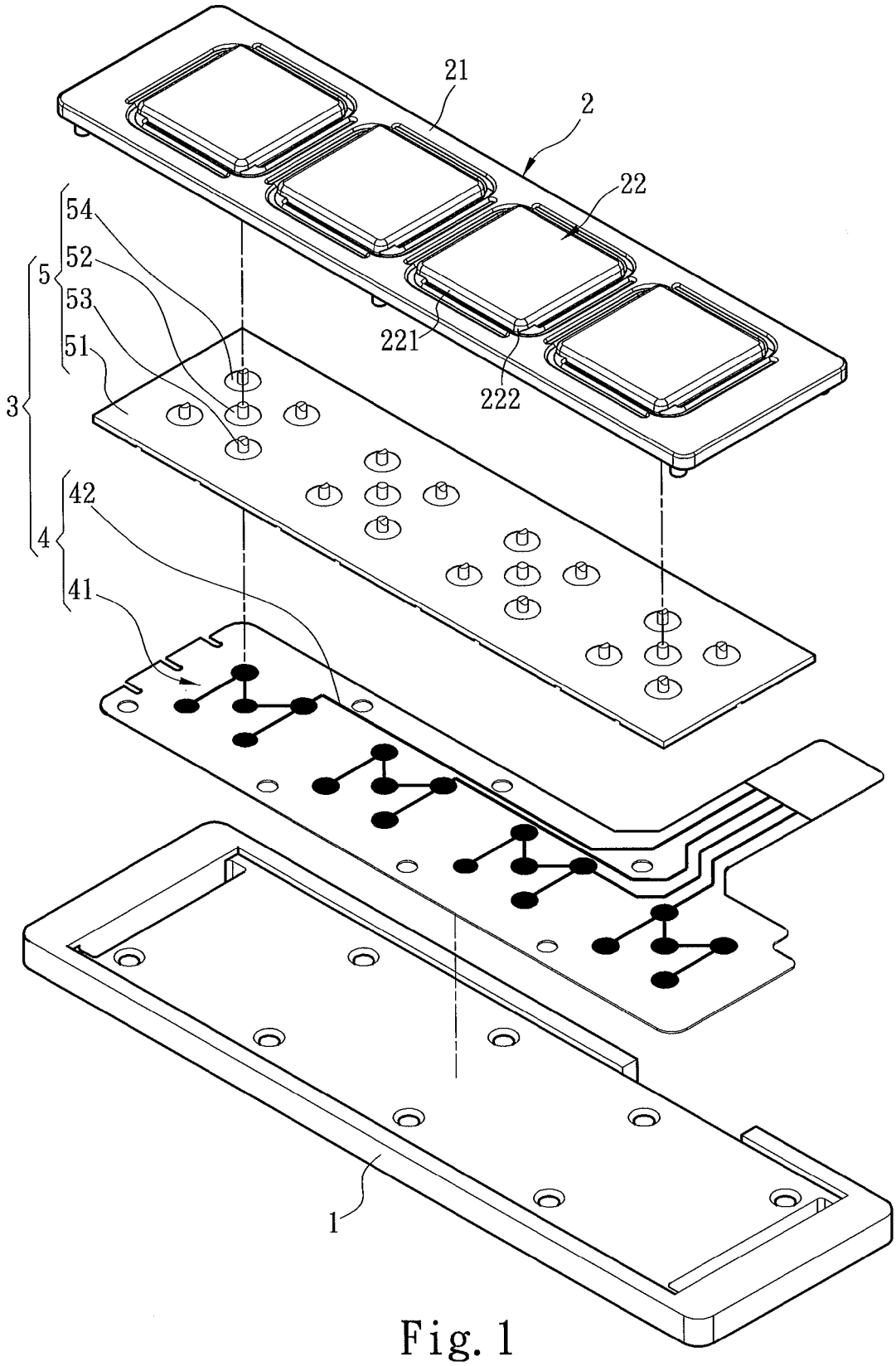
FIG. 1 is an exploded view of the keyboard equipped with multipoint press positions according to the invention.
Figure 2:
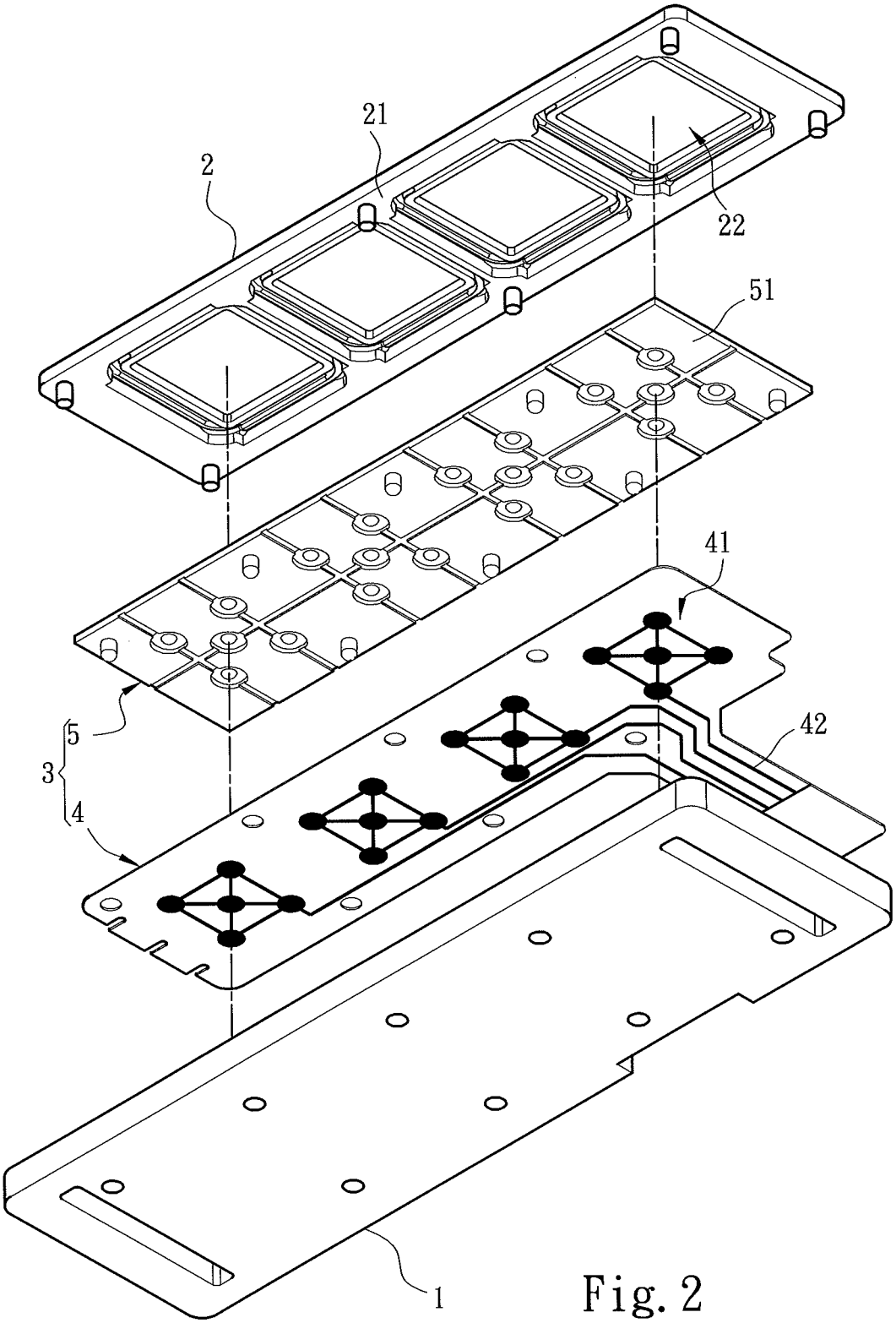
FIG. 2 is another exploded view of the keyboard equipped with multipoint press positions according to the invention viewed from another visual angle.

Please referring to FIGS. 1 through 4, the present invention aims to provide a keyboard equipped with multipoint press positions that includes a baseboard 1, a keycap assembly 2 and a command trigger assembly 3 triggered by the keycap assembly 2 to output keyboard commands. The baseboard 1 aims to support the keycap assembly 2 and the command trigger assembly 3. The keycap assembly 2 mainly includes a support frame 21 and a plurality of keycaps 22 located on the support frame 21. Each keycap 22 has four sides 221 and four corners 222 formed respectively by joining any two of the four sides 221.

The command trigger assembly 3 includes a command circuit board 4 and a plurality of elastic switches 5. The command circuit board 4 includes a plurality of trigger portions 41 corresponding to press positions of the keycaps 22 and triggered by the keycaps 22 to output the keyboard commands, and at least one primary command circuit 42 electrically connected to each trigger portion 41. Each trigger portion 41 includes at least one primary trigger switch 411 corresponding to a central position of each keycap 22 and at least two secondary trigger switches 412 spaced from the primary trigger switch 411 at a preset distance. Each secondary trigger switch 412 has a first auxiliary trigger switch 413 and a second auxiliary trigger switch 414. In other words, the first auxiliary trigger switch 413 and the second auxiliary trigger switch 414 are located respectively at two sides of the primary trigger switch 411 such that the primary trigger switch 411 is located between the first auxiliary trigger switch 413 and the second auxiliary trigger switch 414. As a result, the first auxiliary trigger switch 413, the primary trigger switch 411 and the second auxiliary trigger switch 414 are arranged in a column. Moreover, the primary trigger switch 411 and the secondary trigger switches 412 are interposed by at least one secondary command circuit 415 to form electrical connection thereof. Also referring to FIGS. 3 and 4, in this embodiment the command circuit board 4 includes an upper circuit board 43 and a lower circuit board 44 to hold respectively the primary trigger switches 411 and the secondary trigger switches 412, and a spacer 45 located between the upper circuit board 44 and the lower circuit board 45. The spacer 45 has a plurality of openings 451 corresponding to the primary trigger switch 411 and the secondary trigger switches 412, hence the upper circuit board 43 and the lower circuit board 44 can be set conductive with each other at the openings 451, thereby to output the keyboard commands, but this is not the limitation of the invention. In this embodiment the command circuit board 4 is located above the baseboard 1, hence the lower circuit board 44 is positioned facing the baseboard 1, but this also is not the limitation. Other embodiments can be adopted with the command circuit board 4 located below the baseboard 1, then the upper circuit board 43 faces the baseboard 1, but this also is not the limitation of the invention.

In this embodiment the relative positions of the secondary trigger switches 412 of the trigger portion 41 can be implemented in two types of approaches, although they are not the limitation of the invention. In a first embodiment, the first auxiliary trigger switch 413 and the second auxiliary trigger switch 414 are located respectively on the sides 221 corresponding to the keycap 22. Namely, the first auxiliary trigger switch 413 is corresponding to any two corresponding sides 221 and located between the corresponding sides 221 and the primary trigger switch 411. The second auxiliary trigger switch 414 is located at another side 221 opposing the first auxiliary trigger switch 413 between the another side 221 and the primary trigger switch 411. In a second embodiment, the first auxiliary trigger switch 413 and the second auxiliary trigger switch 414 are located respectively in corresponding to the corners 222 of the keycap 22. In other words, the first auxiliary trigger switch 413 is corresponding to any two corresponding corners 222 and located between the corresponding corners 222 and the primary trigger switch 411. The second auxiliary trigger switch 414 is located opposing another corner 222 of the first auxiliary trigger switch 413 between the another corner 222 and the primary trigger switch 411.

In addition, in this embodiment the primary trigger switch 411 and secondary trigger switches 412 of the trigger portion 41 can be electrically connected, but not limited to, in two types of embodiments. In a first embodiment the secondary command circuits 415 between the primary trigger switch 411 and the secondary trigger switches 412 are wired in a M-shaped layout to form mutual electrical connection as shown in FIGS. 1 through 4. In a second embodiment the secondary command circuits 415 between the primary trigger switch 411 and the secondary trigger switches 412 are wired in a layout of combining a X-shaped format and a □-shaped format to form mutual electrical connection. It is to be noted that aforesaid two types of embodiments cannot be used at the same time in a mixed manner for the trigger portion 41.

Please referring to FIGS. 1 through 4, the elastic switches 5 can be integrally formed or consist of a plurality of independent units. These elastic switches 5 are corresponding to the press positions of the keycaps 22 and depressible by the keycaps 22 to trigger the trigger portion 41 to output the keyboard commands. Moreover, each elastic switch 5 includes a base 51, a primary movement portion 52 located on the base 51 and corresponding to the primary trigger switch 411, a first secondary movement portion 53 located on the base 51 and corresponding to the first auxiliary trigger switch 413, and a second secondary movement portion 54 located on the base 51 and corresponding to the second auxiliary trigger switch 414. The primary movement portion 52 includes a primary deformation section 521 connected to the base 51 and a primary movement strut 522 connected to the primary deformation section 521. The primary movement strut 522 receives press from the keycap 22 and moves towards the command circuit board 4 to trigger the primary trigger switch 411. The primary deformation section 521 provides a return force to the primary movement strut 522 to return to the position prior to pressing. The first secondary movement portion 53 includes a first secondary deformation section 531 and a first secondary movement strut 532 connected to the first secondary deformation section 531. The first secondary movement strut 532 receives press from the keycap 22 and moves towards the command circuit board 4 to trigger the first auxiliary trigger switch 413. The first secondary deformation section 531 provides a return force to the first secondary movement strut 532 to return to the position prior to pressing. The second secondary movement portion 54 includes a second secondary deformation section 541 and a second secondary movement strut 542 connected to the second secondary deformation section 541. The second secondary movement strut 542 receives press from the keycap 22 and moves towards the command circuit board 4 to trigger the second auxiliary trigger switch 414. The second secondary deformation section 541 provides a return force to the second secondary movement strut 542 to return to the position prior to pressing. More specifically, the elastic switches 5 are spaced from the keycaps 22 at a preset distance. The primary deformation section 521, the first secondary deformation section 531 and the second secondary deformation section 541 are formed at a thickness smaller than that of the base 51. Hence when the primary movement strut 522, the first secondary movement strut 532 and the second secondary movement strut 542 are pressed by each keycap 22, the primary deformation section 521, the first secondary deformation section 531 and the second secondary deformation section 541 are deformed to make the primary movement strut 522, the first secondary movement strut 532 and the second secondary movement strut 542 to move towards the command circuit board 4.

Figure 4:
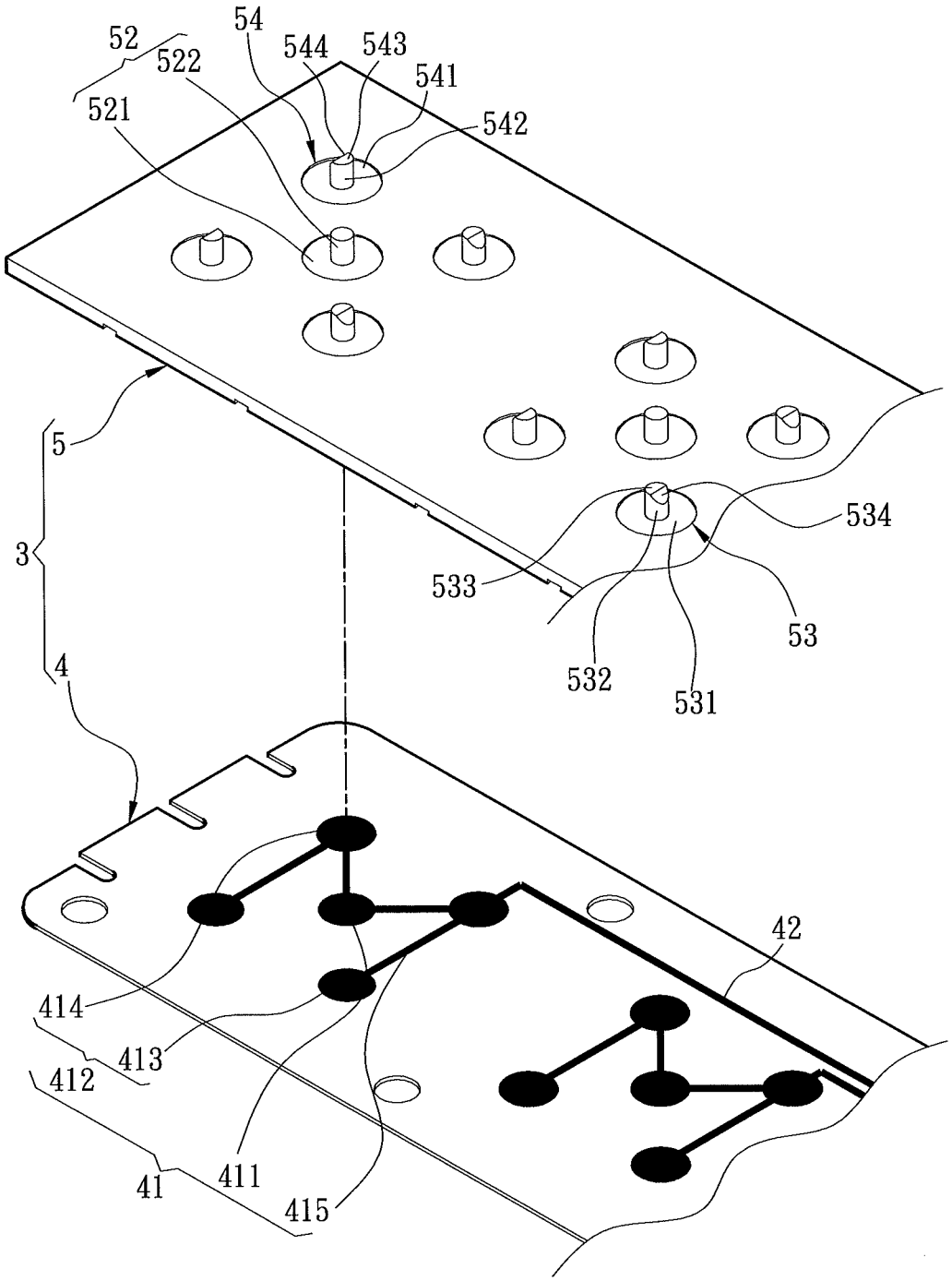
FIG. 4 is an exploded view of the command trigger assembly of the invention.

Please referring to FIG. 4, the first secondary movement strut 532 also includes a first press plane 533 facing each keycap 22 and a first press sloped surface 534 connected to the first press plane 533 and located at one side of the first secondary movement strut 532 remote from the primary movement strut 522. The second secondary movement strut 542 also includes a second press plane 543 facing each keycap 22 and a second press sloped surface 544 connected to the second press plane 543 and located at one side of the second secondary movement strut 542 remote from the primary movement strut 522. The first press sloped surface 534 and the second press sloped surface 544 aim to increase contact area between the first secondary movement portion 53 and the second secondary movement portion 54 and the keycap 22. Thus, when the keycap 22 is inclined toward the first secondary movement portion 53 and the second secondary movement portion 54 the tilted keycap 22 still can steadily touch the first press sloped surface 534 of the first secondary movement strut 532 or the second press sloped surface 544 of the second secondary movement strut 542.

Figure 5:
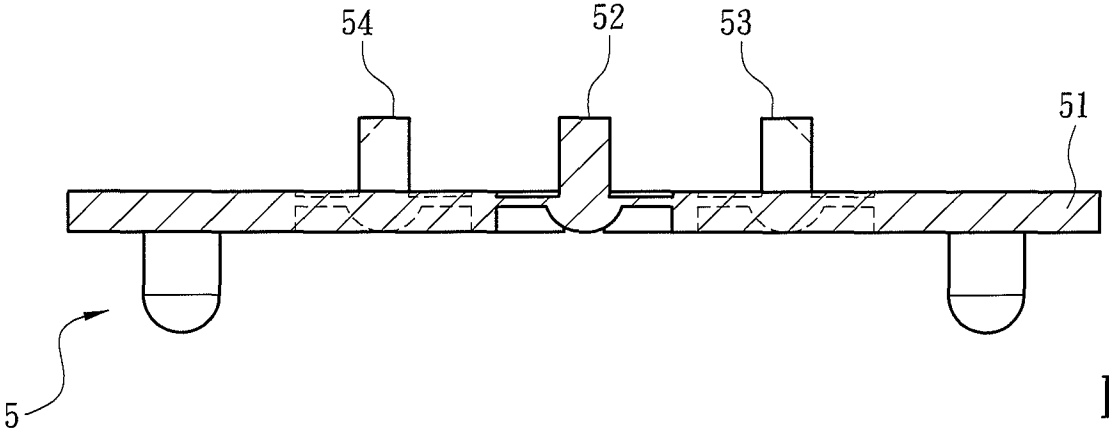
FIG. 5 is a sectional view of a first embodiment of the elastic switch of the invention.
Figure 6:
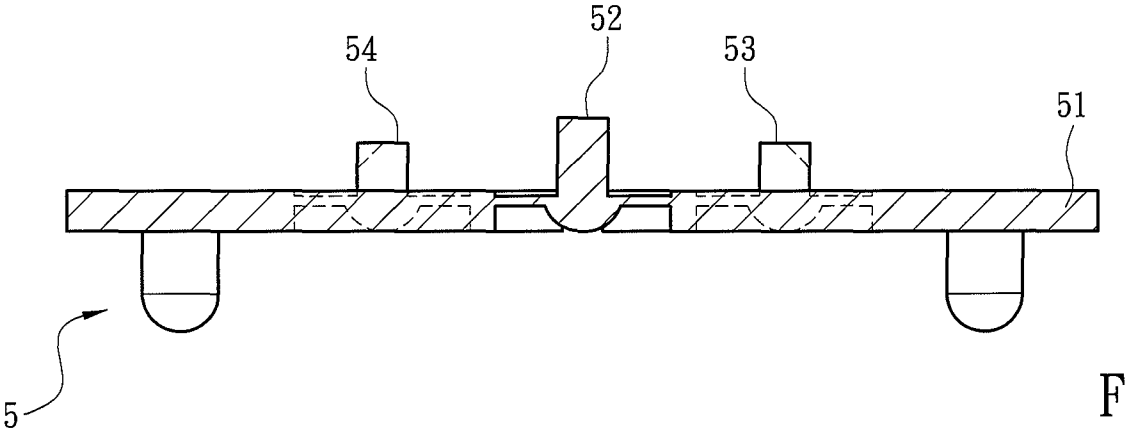
FIG. 6 is a sectional view of a second embodiment of the elastic switch of the invention.

In this embodiment the elastic switches 5 can be implemented in two types of fashions. In a first fashion, the primary movement portion 52 is formed at a length same as that of the first secondary movement portion 53 and the second secondary movement portion 54 as shown in FIG. 5. In a second fashion, the primary movement portion 52 is formed at a length greater than that of the first secondary movement portion 53 and the second secondary movement portion 54 as shown in FIG. 6.

Figure 7:
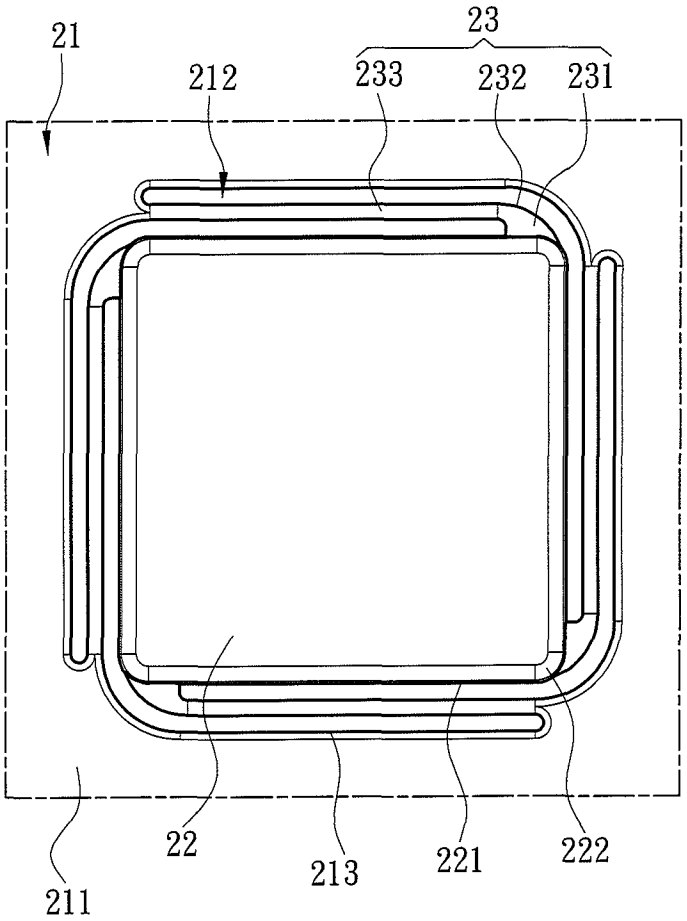
FIG. 7 is schematic view-1 of a first embodiment of the keycap assembly of the invention.
Figure 8:
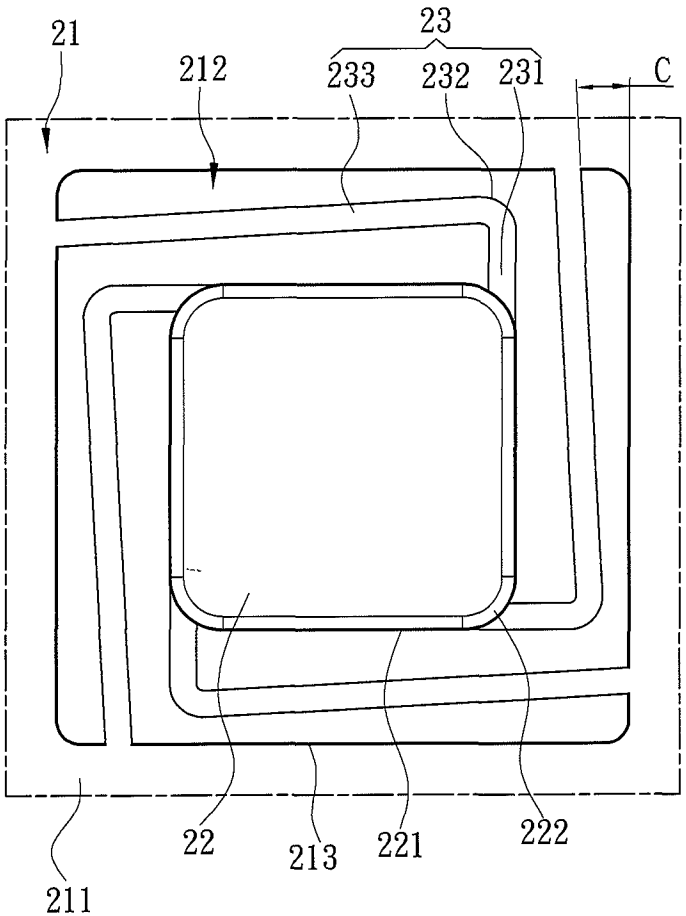
FIG. 8 is schematic view-2 of the first embodiment of the keycap assembly of the invention.
Figure 9:
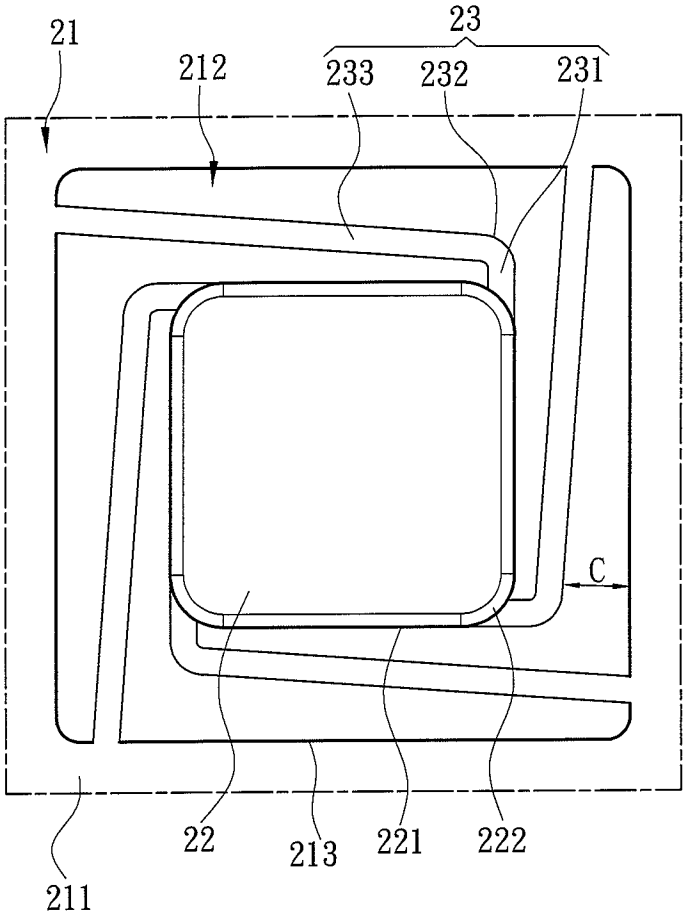
FIG. 9 is schematic view-3 of the first embodiment of the keycap assembly of the invention.

Please referring to FIGS. 7 through 9, the keycap assembly 2 can be implemented in two types of embodiments. In a first embodiment the support frame 21 includes a plurality of installation apertures 212 defined by a plurality of bracing stems 211 arranged in a staggered manner to hold the keycaps 22. The bracing stems 211 include a plurality of wall surfaces 213 facing the sides 221. The four sides 221 and the wall surfaces 213 are bridged by four movable racks 23 respectively. The four movable racks 23, the keycaps 22 and the bracing stems 211 are integrally formed by injection. Each movable rack 23 has a first stem connecting section 231 connected to any one of the corners 222, and a bracing arm section 233 connected to any one corner 222 via a first bend spot 232 toward another corner 222 to bridge the first stem connecting section 231 and another bracing stem 211. But this is not the limitation of the invention. The bracing arm section 233 is extended parallel against the wall surface 213 as shown in FIG. 7. The bracing arm section 233 also can be extended against the wall surface 213 at an inclined angle C as shown in FIGS. 8 and 9.

Figure 10:
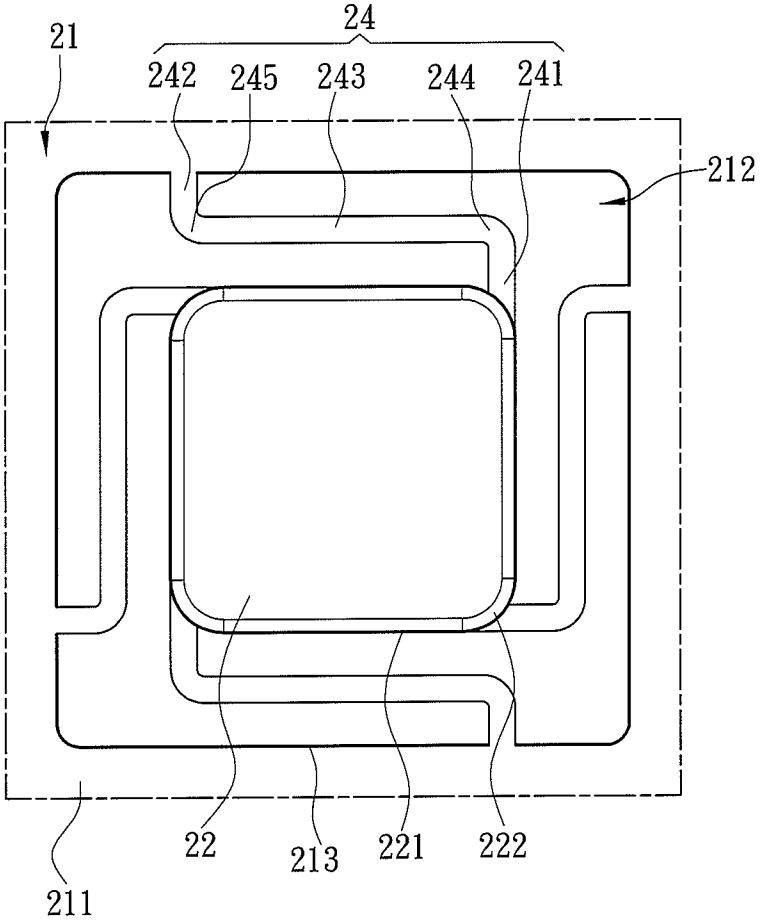
FIG. 10 is a schematic view of a second embodiment of the keycap assembly of the invention.

Please refer to FIG. 10 for a second embodiment of the keycap assembly 2 in which the support frame 21 includes a plurality of installation apertures 212 defined by a plurality of bracing stems 211 arranged in a staggered manner to hold the keycaps 22. The bracing stems 211 include a plurality of wall surfaces 213 facing the sides 221. The four sides 221 and the wall surfaces 213 are bridged by four movable racks 24 respectively. The movable racks 24, the keycaps 22 and the bracing stems 211 are integrally formed by injection. Each movable rack 24 has a first stem connecting section 241, a second stem connecting section 242 and a bracing arm section 243 to bridge the first stem connecting section 241 and the second stem connecting section 242. The first stem connecting section 241 is connected to any one of the corners 222. The bracing arm section 243 is connected to the first stem connecting section 241 between the side 221 and the bracing stem 211 via a first bend spot 244 toward another corner 222, and connected to the another corner 222 via a second bend spot 245 to form the second stem connecting section 242 to connect to the bracing stem 211. But this also is not the limitation of the invention. The bracing arm section 243 is parallel with the wall surface 213, but is not limited to such a manner.

Figure 3:
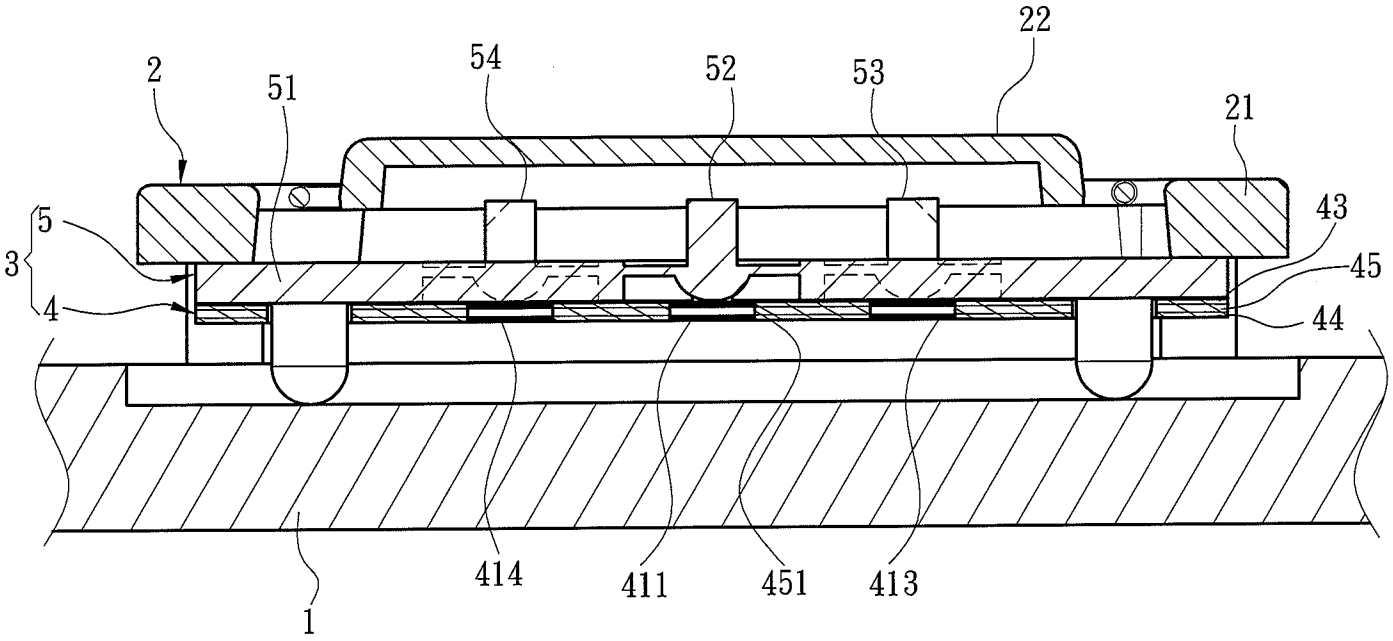
FIG. 3 is a cross section view of the keyboard equipped with multipoint press positions according to the invention.

Please referring to FIGS. 3, 4 and 7, to facilitate explanation of movement of the keyboard equipped with multipoint press positions of the invention, the first embodiment of the keycap assembly 2 mentioned above is taken for discussion as follows: When a user presses the keycap 22, the keycap 22 and the bracing arm sections 233 of the movable racks 23 are moved at the same time towards the elastic switches 5, consequentially the keycap 22 presses the primary movement portion 52, the first secondary movement portion 53 and the second secondary movement portion 54 of the elastic switches 5. Meanwhile, the primary movement portion 52, the first secondary movement portion 53 and the second secondary movement portion 54 are pressed to deform the primary deformation section 521, the first secondary deformation section 531 and the second secondary deformation section 541, while the primary movement strut 522, the first secondary movement strut 532 and the second secondary movement strut 542 are moved at the same time towards the command circuit board 4; consequentially, the primary movement strut 522, the first secondary movement strut 532 and the second secondary movement strut 542 set on the primary trigger switch 411, the first auxiliary trigger switch 413 or the second auxiliary trigger switch 414 to output the keyboard commands. Moreover, in the event that the user presses merely a corner of the keycap 22 the keycap 22 can still press the first secondary movement portion 53 or the second secondary movement portion 54 to make the first secondary movement strut 532 or the second secondary movement strut 542 to set on the first auxiliary trigger switch 413 or the second auxiliary trigger switch 414; or make the first secondary movement strut 532 and the second secondary movement strut 542 to set on the first auxiliary trigger switch 413 and the second auxiliary trigger switch 414 at the same time. As a result, the keyboard equipped with multipoint press positions of the invention has higher press sensitivity, and through the elastic switches 5 total size of the keyboard can be shrunk as desired.

As a conclusion, the keyboard equipped with multipoint press positions of the invention includes a baseboard, a keycap assembly and a command trigger assembly triggered by the keycap assembly to output keyboard commands. The command trigger assembly includes a command circuit board and a plurality of elastic switches. Through the keycaps and the elastic switches total size of the keyboard can be reduced to make the keyboard thinner and lighter in weight. In addition, through the elastic switches and the trigger switches any spot of the keycap can be pressed to make the elastic switches to set on the trigger switches, therefore achieve higher press sensitivity.

What is claimed is:

1. A keyboard equipped with multipoint press positions, comprising at least a baseboard, a keycap assembly and a command trigger assembly triggered by the keycap assembly to output keyboard commands, the keycap assembly including a support frame and a plurality of keycaps located on the support frame, the command trigger assembly including:

a command circuit board which includes a plurality of trigger portions corresponding to press positions of the keycaps and triggered by the keycaps to output a plurality of keyboard commands and at least one primary command circuit electrically connected to each trigger portion, each trigger portion including at least one primary trigger switch corresponding to a central position of each keycap and at least two secondary trigger switches spaced from the primary trigger switch at a preset distance, each secondary trigger switch including a first auxiliary trigger switch and a second auxiliary trigger switch opposing each other relative to the primary trigger switch, the primary trigger switch and the secondary trigger switches being interposed by at least one secondary command circuit to form electrical connection thereof, wherein the at least one of the primary command circuit of the trigger portions is triggered by the primary trigger switch and out puts one of the keyboard commands, wherein each of the at least one secondary command circuit of the trigger portions corresponding to the primary command circuit is triggered by the secondary trigger switches and generates the same keyboard command as the primary command circuit outputs; and a plurality of elastic switches corresponding to the press positions of the keycaps and depressible by the keycaps to trigger the trigger portions to output the keyboard commands, each elastic switch including a base, a primary movement portion located on the base and corresponding to the primary trigger switch, a first secondary movement portion located on the base and corresponding to the first auxiliary trigger switch and a second secondary movement portion located on the base and corresponding to the second auxiliary trigger switch, wherein the primary movement portion includes a primary movement strut depressible by the keycap to move towards the command circuit board to trigger the primary truer switch and a primary deformation section connected to the primary movement strut to provide a return force to the primary movement strut, the first secondary movement portion including a first secondary movement strut depressible by the keycap to move towards the command circuit board to trigger the first auxiliary trigger switch and a first secondary deformation section connected to the first secondary movement strut to provide a return force to the first secondary movement strut, the second secondary movement portion including a second secondary movement strut depressible by the keycap to move towards the command circuit board to trigger the second auxiliary trigger switch and a second secondary deformation section connected to the second secondary movement strut to provide a return force to the second secondary movement strut, and wherein the first secondary movement strut includes a first press plane facing the keycap and a first press sloped surface connected to the first press plane and located at one side of the first secondary movement strut remote from the primary movement strut, and the second secondary movement strut includes a second press plane facing the keycap and a second press sloped surface connected to the second press plane and located at one side of the second secondary movement strut remote from the primary movement strut.

2. The keyboard equipped with multipoint press positions of claim 1, wherein each keycap includes four sides and four corners formed respectively by joining any two of the four sides, the first auxiliary trigger switch corresponding any two opposing sides and located between one of the two opposing sides and the primary trigger switch, the second auxiliary trigger switch corresponding the two opposing sides and located between another one of the two opposing sides and the primary trigger switch.

3. The keyboard equipped with multipoint press positions of claim 1, wherein each keycap includes four sides and four corners formed respectively by joining any two of the four sides, the first auxiliary trigger switch corresponding any two opposing corners and located between one of the two opposing corners and the primary trigger switch, the second auxiliary trigger switch corresponding the two opposing corners and located between another one of the two opposing corners and the primary trigger switch.

4. The keyboard equipped with multipoint press positions of claim 1, wherein the primary movement portion is formed at a length greater than that of the first secondary movement portion and the second secondary movement portion.

5. The keyboard equipped with multipoint press positions of claim 1, wherein the command circuit board includes a lower circuit board and an upper circuit board to hold respectively the primary trigger switch and the secondary trigger switches, and a spacer located between the lower circuit board and the upper circuit board and including a plurality of openings corresponding to the primary trigger switch and the secondary trigger switches.

6. The keyboard equipped with multipoint press positions of claim 1, wherein the support frame includes a plurality of installation apertures defined by a plurality of bracing stems arranged in a staggered manner to hold the keycaps, each keycap including four sides and four corners formed respectively by joining of any two of the four sides, the bracing stems including a plurality of wall surfaces facing the four sides, the four sides and the wall surfaces being bridged by four movable racks respectively, the movable racks, the keycaps and the bracing stems being integrally formed by injection, each movable rack including a first stem connecting section connected to any one of the corners and a bracing arm section connected to the first stem connecting section and connected to the any one of the corners via a first bend spot towards another corner to connect to another bracing stem.

7. The keyboard equipped with multipoint press positions of claim 1, wherein the support frame includes a plurality of installation apertures defined by a plurality of bracing stems arranged in a staggered manner to hold the keycaps, each keycap including four sides and four corners formed respectively by joining of any two of the four sides, the bracing stems including a plurality of wall surfaces facing the four sides, the four sides and the wall surfaces being bridged by four movable racks respectively, the movable racks, the keycaps and the bracing stems being integrally formed by injection, each movable rack including a first stem connecting section, a second stem connecting section and a bracing arm section to bridge the first stem connecting section and the second stem connecting section, the first stem connecting section being connected to any one of the corners, the bracing arm section being connected to the first stem connecting section via a first bend spot and extending between the side and the bracing stem toward another corner to form the second stem connecting section by extending from the another corner via a second bend spot to connect to the bracing stem.

* * * * *